US008929765B2

(12) United States Patent
Hamaya et al.

(10) Patent No.: US 8,929,765 B2
(45) Date of Patent: Jan. 6, 2015

(54) IMAGE FORMING APPARATUS

(71) Applicants: Masahito Hamaya, Nagoya (JP); Yoshihiro Okamoto, Kasugai (JP)

(72) Inventors: Masahito Hamaya, Nagoya (JP); Yoshihiro Okamoto, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/851,265

(22) Filed: Mar. 27, 2013

(65) Prior Publication Data

US 2013/0322911 A1 Dec. 5, 2013

(30) Foreign Application Priority Data

May 29, 2012 (JP) ..... 2012-122054

(51) Int. Cl.
*G03G 15/00* (2006.01)

(52) U.S. Cl.
CPC ..... *G03G 15/80* (2013.01)
USPC ..... 399/88; 399/113

(58) Field of Classification Search
USPC ..... 399/88, 90, 113, 114
See application file for complete search history.

(56) References Cited

U.S. PATENT DOCUMENTS

| | | | |
|---|---|---|---|
| 5,561,499 | A | 10/1996 | Setoriyama |
| 6,778,197 | B2 | 8/2004 | Yamanaka |
| 7,224,583 | B2 | 5/2007 | Marumoto |
| 7,303,346 | B2 | 12/2007 | Ogi et al. |
| 7,349,208 | B2 | 3/2008 | Marumoto |
| 7,627,262 | B2 | 12/2009 | Omura et al. |
| 7,873,294 | B2 | 1/2011 | Nobe et al. |
| 8,112,011 | B2 | 2/2012 | Nobe et al. |
| 2003/0117477 | A1 | 6/2003 | Yamanaka |
| 2004/0130700 | A1 | 7/2004 | Ogi et al. |
| 2005/0264993 | A1 | 12/2005 | Marumoto |
| 2006/0034633 | A1 | 2/2006 | Tsusaka et al. |
| 2006/0160381 | A1 | 7/2006 | Omura et al. |
| 2007/0211427 | A1 | 9/2007 | Marumoto |
| 2007/0230988 | A1 | 10/2007 | Nobe et al. |
| 2011/0076047 | A1 | 3/2011 | Nobe et al. |
| 2011/0158675 | A1 | 6/2011 | Inukai |
| 2012/0027436 | A1 | 2/2012 | Maruyama et al. |

FOREIGN PATENT DOCUMENTS

| | | | |
|---|---|---|---|
| JP | 57-035097 | U | 2/1982 |
| JP | 6-115217 | A | 4/1994 |
| JP | 6-236082 | A | 8/1994 |
| JP | 6-314000 | A | 11/1994 |
| JP | 7-129061 | A | 5/1995 |
| JP | 9-222843 | A | 8/1997 |
| JP | 2001-290323 | A | 10/2001 |

(Continued)

*Primary Examiner* — David Bolduc
*Assistant Examiner* — Barnabas Fekete
(74) *Attorney, Agent, or Firm* — Banner & Witcoff, Ltd.

(57) ABSTRACT

An image forming apparatus is configured to electro-photographically form an image and includes a main body frame which includes a side wall, an outer cover which covers an outer face of the main body frame, a high-voltage board which includes a high-voltage generator circuit configured to generate a high voltage and supply an electric power to a device requiring a high-voltage power source, and a main board which includes a main control circuit configured to perform a control on an image forming process of the image forming apparatus. In a side region which is formed by the side wall of the main body frame and the outer cover, the high-voltage board and the main board are disposed along the side wall to overlap with each other at least partially, and the high-voltage board is disposed on an outer side relative to the main board.

7 Claims, 4 Drawing Sheets

CROSS-SECTIONAL VIEW TAKEN ALONG LINE A-A

(56) References Cited

FOREIGN PATENT DOCUMENTS

| | | | |
|---|---|---|---|
| JP | 2001-318496 | A | 11/2001 |
| JP | 2002-268309 | A | 9/2002 |
| JP | 2002-289753 | A | 10/2002 |
| JP | 2003-195594 | A | 7/2003 |
| JP | 2004-177602 | A | 6/2004 |
| JP | 2004-264488 | A | 9/2004 |
| JP | 2005-031447 | A | 2/2005 |
| JP | 2005-084410 | A | 3/2005 |
| JP | 2005-340598 | A | 12/2005 |
| JP | 2006-053254 | A | 2/2006 |
| JP | 2006-154257 | A | 6/2006 |
| JP | 2007-152609 | A | 6/2007 |
| JP | 2007-158127 | A | 6/2007 |
| JP | 2007-261154 | A | 10/2007 |
| JP | 2007-261240 | A | 10/2007 |
| JP | 2009-109637 | A | 5/2009 |
| JP | 2011-066039 | A | 3/2011 |
| JP | 2011-139606 | A | 7/2011 |
| JP | 2012-032531 | A | 2/2012 |

CROSS-SECTIONAL VIEW TAKEN ALONG LINE A-A

IMAGE FORMING APPARATUS

CROSS-REFERENCE TO RELATED APPLICATION

This application claims priority from Japanese Patent Application No. 2012-122054, filed on May 29, 2012, the entire subject matter of which is incorporated herein by reference.

TECHNICAL FIELD

Aspects of the present invention relate to an image forming apparatus configured to electro-photographically form an image.

BACKGROUND

An image forming apparatus configured to electro-photographically form an image, such as a laser printer includes a low-voltage circuit which lowers a commercial voltage (for example, 100 V) from an external power source such as a plug to a predetermined low voltage, a main control circuit which receives supply of an electric power from the low-voltage circuit, controls various devices, and performs control on an image forming process of the image forming apparatus, and a high-voltage generator circuit which generates a high voltage and supplies an electric power to devices requiring a high-voltage power source, such as chargers and transfer units, and so on. Also, various boards used for configuring those circuits are disposed at predetermine positions of the image forming apparatus.

Recently, reduction of the size of image forming apparatuses is highly demanded. In reducing the size of image forming apparatuses, the way of arranging those boards is an issue, and a technique is proposed in, for example, JP-A-2007-152609. That is, in the technique of JP-A-2007-152609, a first electric board including a high-voltage generator circuit and a second electric board configuring a main control circuit are overlapped on one side surface of an image forming apparatus such that the first and second electric boards are arranged in parallel and close to each other. According to this configuration, for example, as compared to a case of arranging the boards on two sides of the image forming apparatus such that the boards face each other, it is possible to concentrically arrange the boards. Therefore, it is possible to reduce the size of the image forming apparatus, and make an interface between the boards shorter.

However, if the boards are simply arranged to overlap and be close to each other, the following problems occur. That is, since the boards are concentrically arranged in a limited region, that is, one side surface of the image forming apparatus, electric radiation noise, heat, or the like generated at each board may cause each board to abnormally operate, and electric radiation noise leaked from the boards to the outside may influence external devices.

Particularly, the high-voltage generator circuit includes a transistor which serves as a switching element to be turned on or off for controlling an electric current, a transformer which generates a back electromotive force to increase a voltage, and so on. Therefore, if the board of the main control circuit is overlapped on the board of the high-voltage generator circuit configured as described above, a possibility that the main control circuit having an important role will directly receive electric radiation noises generated from the transistor or the transformer of the high-voltage generator circuit and malfunction increases. Also, the electric radiation noise generated from the board of the main control circuit may be leaked to the outside and influence external devices or the like arranged closely.

For this reason, it may be conceivable to provide a countermeasure on the boards to shield electric radiation noise, heat, and the like, for example, by additionally providing a shield plate. In this case, the boards increase in size, and thus it may be difficult to contribute to size-reduction of the image forming apparatus.

SUMMARY

Accordingly, an aspect of the present invention provides a technique of appropriately arranging a board of a high-voltage generator circuit, a board of a main control circuit, and the like in a limited region of an image forming apparatus so as to shorten the distance between the boards while reducing the size of the boards, thereby reducing the size of the image forming apparatus.

According to an illustrative embodiment of the present invention, there is provided an image forming apparatus configured to electro-photographically form an image and includes a main body frame, an outer cover, a high-voltage board, and a main board. The main body frame includes a side wall. The outer cover covers an outer face of the main body frame. The high-voltage board includes a high-voltage generator circuit configured to generate a high voltage and supplies an electric power to a device requiring a high-voltage power source. The main board includes a main control circuit configured to perform a control on an image forming process of the image forming apparatus. In a side region which is formed by the side wall of the main body frame and the outer cover, the high-voltage board and the main board are disposed along the side wall to overlap with each other at least partially, and the high-voltage board is disposed on an outer side relative to the main board.

According to the above configuration, it may be possible to use the high-voltage board as the shield plate of the main board, to suppress an external device from being influenced by electric radiation noises radiated from the main board, and to reduce the electric radiation noises or the like applied to the main board from the outside. Also, it is unnecessary to separately provide a shield plate dedicated for the main board, and it is possible to efficiently use the limited side region of the image forming apparatus. As a result, it is possible to contribute to size-reduction of the image forming apparatus.

BRIEF DESCRIPTION OF THE DRAWINGS

The above and other aspects of the present invention will become more apparent and more readily appreciated from the following description of illustrative embodiments of the present invention taken in conjunction with the attached drawings, in which.

DETAILED DESCRIPTION

<Overall Configuration of Laser Printer>

Figure 1:
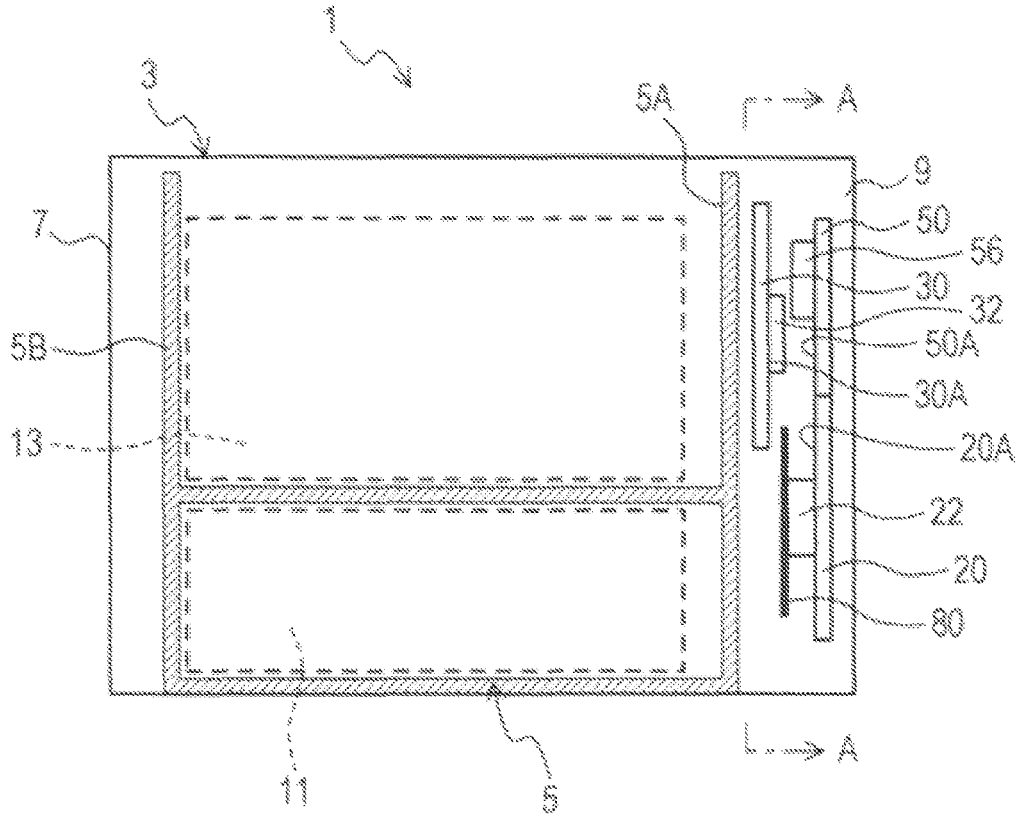
FIG. 1 is a front cross-sectional view schematically illustrating the configuration of a laser printer 1 according to an illustrative embodiment.

Hereinafter, an illustrative embodiment of the present invention will be described with reference to FIGS. 1 to 4. An image forming apparatus according to the present invention is a laser printer 1 configured to electro-photographically form an image. As shown in FIG. 1, the laser printer 1 includes a sheet cassette 11 and a process cartridge 13 which are accommodated in a casing 3 having a substantially box shape.

The sheet cassette 11 receives sheets for transferring images thereon, and is provided at a lower portion of the casing 3. The process cartridge 13 is a device configured to form an image and is provided above the sheet cassette 11. For example, the process cartridge 13 includes a photosensitive drum, a scorotron charger, a developer cartridge, a transfer roller, and so on, and receives high-voltage power from a high-voltage board 50 (to be described later) to perform processes such as charging, developing, and transferring. FIG. 1 is a front cross-sectional view schematically illustrating the configuration of the laser printer 1.

The casing 3 includes a main body frame 5 serving as a framework, and an outer cover 7 made of a synthetic resin and covering the outer face of the main body frame 5. The main body frame 5 includes a pair of side walls 5A and 5B facing each other, and at a side portion of the casing 3 (the right side in FIG. 1), a side region 9 is formed (defined) by the side wall 5A and the outer cover 7.

Figure 2:
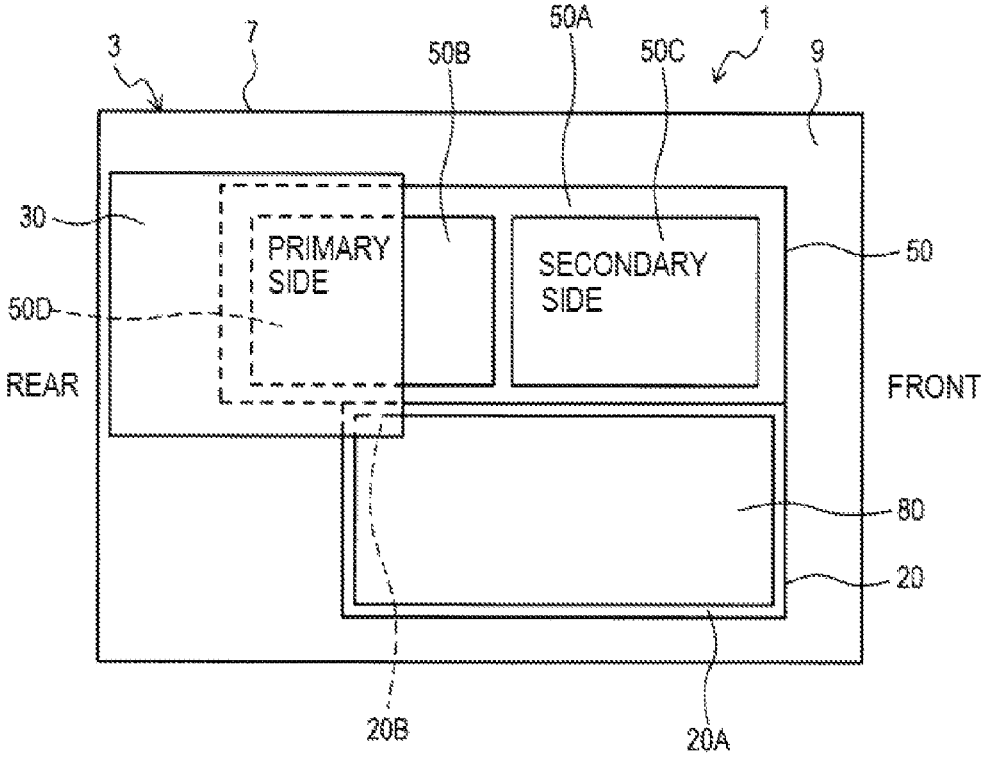
FIG. 2 is a cross-sectional view taken along a line A-A of FIG. 1 and illustrating the arrangement of a low-voltage board 20, a main board 30, and a high-voltage board 50 according to the illustrative embodiment.

As shown in FIGS. 1 and 2, the side region 9 concentrically accommodates a low-voltage board 20 which has a low-voltage circuit configured for lowering a commercial voltage from an external power source such as a plug to a predetermined low voltage, a main board 30 which has a main control circuit for performing control on an image forming process of the laser printer 1, and a high-voltage board 50 which has a high-voltage generator circuit for generating a high voltage to supply an electric power to a device requiring a high-voltage power source, for example, a high-voltage generator circuit for supplying a high voltage to the scorotron charger for uniformly charging a surface of the photosensitive drum, the transfer roller for feeding toner (developer) to an electrostatic latent image formed on the surface of the photosensitive drum, a transfer roller for transferring the developed toner image (developer image) on the photosensitive drum onto a recording sheet, and the like. FIG. 2 is a cross-sectional view taken along a line A-A of FIG. 1 and illustrating the arrangement of the low-voltage board 20, the main board 30, and the high-voltage board 50 according to the illustrative embodiment.

<Board Configuration of Laser Printer>

Figure 3:
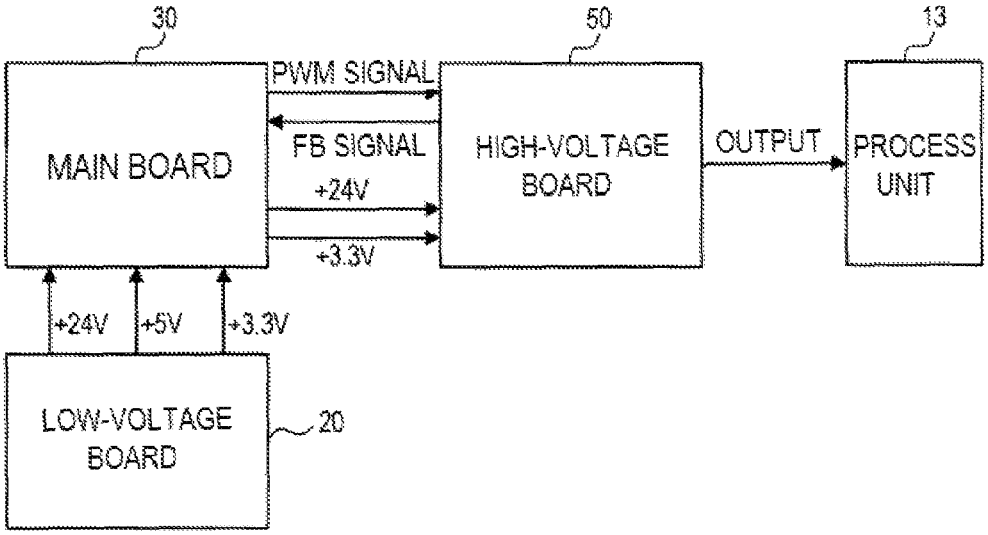
FIG. 3 is a block diagram illustrating the board configuration of the laser printer 1 according to the illustrative embodiment.

The board configuration of the laser printer 1 will be described with reference to FIG. 3. FIG. 3 is a block diagram illustrating the board configuration of the laser printer 1. The board configuration of the laser printer 1 includes the low-voltage board 20, the main board 30, and the high-voltage board 50 accommodated in the side region 9 as described above.

The low-voltage board 20 is a circuit board which receives supply of an electric power from a commercial power source (not shown), for example, a plug of a power source of 100 V, divides or transforms the electric power for uses, for example, into 3.3 V for a control circuit, 5 V for an interface, and 24 V for driving a transformer of the high-voltage board 50, and supplies an electricity to the main board 30 and so on, and is configured to flow a higher current therein as compared to the main board 30 and the high-voltage board 50.

The main board 30 is a circuit board which includes a CPU, a ROM, a RAM, and so on (not shown), receives supply of an electric power from the low-voltage board 20, and controls each unit of the laser printer 1. The main board 30 supplies, to the high-voltage board 50, a PWM signal for controlling an output power of the high-voltage board 50 and receives an FB signal as a return signal of an output power from a secondary side of the transformer of the high-voltage board 50, and performs a control such that the duty ratio of the PWM signal changes.

The high-voltage board 50 is a circuit board which receives power supply voltages of 3.3 V and 24 V from the low-voltage board 20 through the main board 30, raises the supplied voltages on the basis of the PWM signal supplied from the main board 30, inputs an output to the process unit 13, and feeds back a portion of the output as the FB signal to the main board 30. Also, although the high-voltage board 50 is configured to receive supply of the power supply voltages through the main board 30 in FIG. 3, the high-voltage board 50 may be configured to receive supply of the power supply voltages directly from the low-voltage board 20.

<Circuit Configuration of High-Voltage Board>

Figure 4:
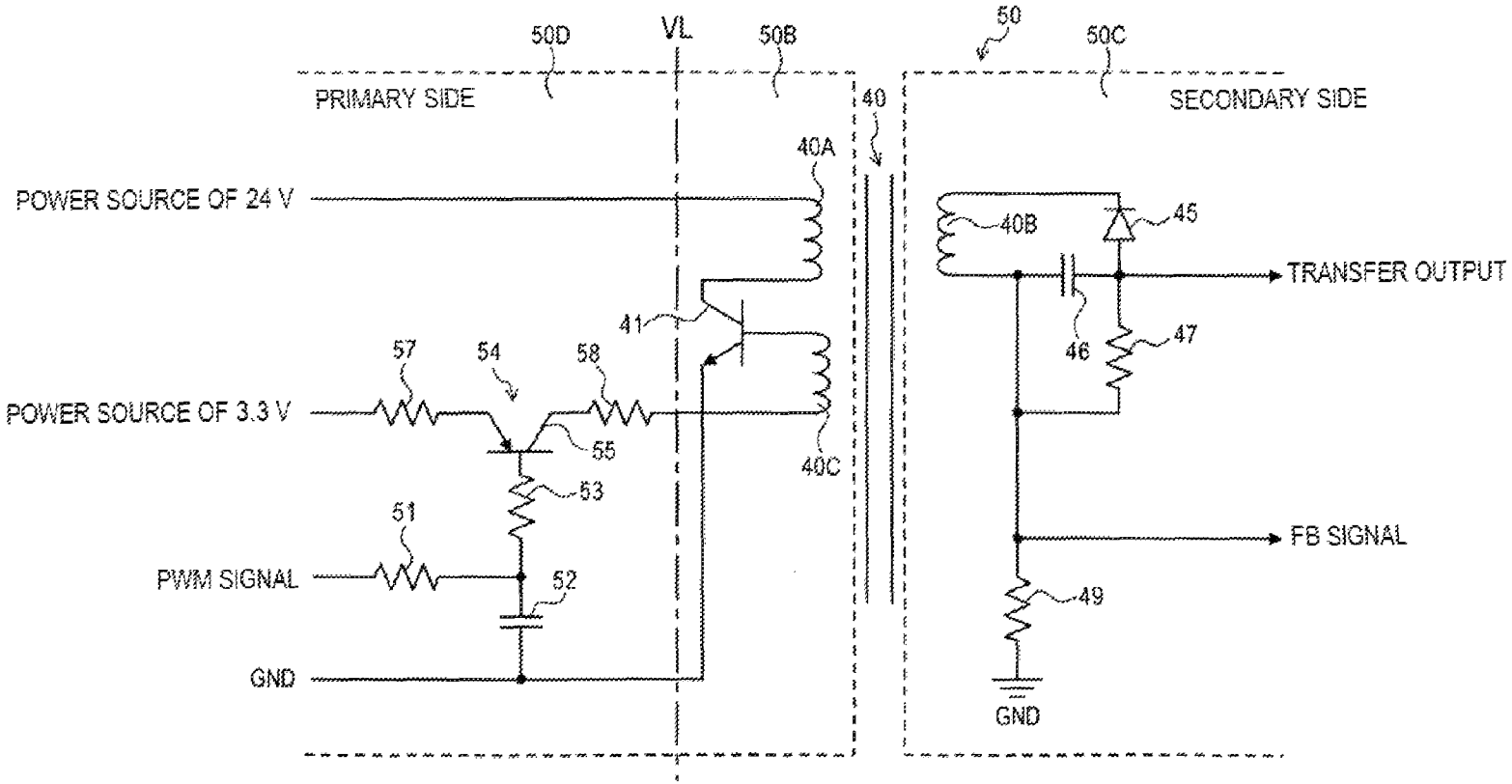
FIG. 4 is a circuit diagram illustrating a portion of the configuration of the high-voltage board 50 according to the illustrative embodiment.

The circuit configuration of the high-voltage board 50 will be described with reference to FIG. 4. FIG. 4 is a circuit diagram illustrating a portion of the configuration of the high-voltage board 50. The high-voltage board 50 includes a transformer 40 which serves as a transforming element in which a current flows in a primary coil 40A by supply of an electric power from a DC power source of 24 V, and is converted into magnetic energy by a core, and the energy is transferred to a secondary coil 40B, thereby converted into a current, a transistor 41 which servers as a switching element for switching a current to flow in the primary coil 40A, and a current control unit 54 which controls the base current of the transistor 41. Also, between the base of the transistor 41 and the current control unit 54, an auxiliary coil 40C of the transformer 40 is provided.

The current control unit 54 includes a PWM signal smoothing circuit including a resistor 51 and a capacitor 52 and configured to smooth the output PWM signal, and a transistor 55 which has a base applied with a voltage between the resistor 51 and the capacitor 52 through a resistor 53. Also, the emitter of the transistor 55 is connected to a DC power source of 3.3 V through a resistor 57, and the collector of the transistor 55 is connected to the auxiliary coil 40C through a resistor 58.

In the high-voltage board 50 having the above-mentioned configuration, if the PWM signal is output, the voltage of the PWM signal is smoothed by the resistor 51 and the capacitor 52, and is applied to the transistor 55. Then, if the duty ratio of the PWM signal changed according to the value of the FB signal by the main board 30 becomes a predetermined value, the transistor 55 is turned on such that a current corresponding to a collector current flows, and a base current flows in the transistor 41 through the auxiliary coil 40C. Then, the transistor 41 is turned on such that the collector current flows from the DC power source of 24 V through the primary coil 40A, and the magnetic flux of the transformer 40 increases.

Since the collector current does not become an upper current limit value obtained only by amplifying the current value of the base current with the amplification factor of the transistor 41, the collector current of the transistor 41 is saturated. Then, the increase of the magnetic flux supplied from the primary coil 40A is eliminated, a potential between both ends of the auxiliary coil 40C is reduced, the base current of the transistor 41 decreases, and the transistor 41 is suddenly turned off. At this time, the energy stored in the transformer 40 is transferred to the secondary coil 40B by the back electromotive force of the transformer 40, whereby the voltage is raised. As a result, a high voltage is generated at the secondary coil 40B.

The secondary coil 40B is connected directly to a rectifying diode 45, and between both ends of a series circuit composed of the secondary coil 40B and the diode 45, a smoothing capacitor 46 and a discharging resistor 47 are connected in parallel such that transfer output in which electric power is supplied from the high voltage side of the secondary coil 40B to the transfer roller is performed. Also, the low voltage side of the secondary coil 40B is grounded through a resistor 49, and a voltage generated by a current flowing in the resistor 49 is input as the FB signal to the main board 30.

The high-voltage board 50 of FIG. 4 is shown to have only a high-voltage generator circuit for a transfer current (transfer output) which is supplied to the transfer roller of the process unit 13, and is configured such that a transfer bias is applied between the photosensitive drum and the transfer roller by constant current control. A power supply system for generating a high voltage for other devices (such as the scorotron charger and the developing roller) to supply an electric power is substantially the same as that for the transfer roller, and thus is not shown. Here, in a case where the high voltage which is supplied to the scorotron charger, the developing roller, and so on has a polarity different from that of the high voltage which is supplied to the transfer roller and the constant current control is necessary, the circuit configuration is made such that a voltage proportional to the output voltage is input as the FB signal to the main board 30.

<Board Arrangement of Laser Printer>

The arrangement of the low-voltage board 20, the main board 30, and the high-voltage board 50 accommodated in the side region 9 of the laser printer 1 will be described in detail with reference to FIGS. 1, 2, and 4. First, the main board 30 is provided to stand along the side wall 5A of the main body frame 5 which stands vertically as shown in FIG. 1. In this case, the main board 30 is disposed such that a component mounting surface 30A faces the outer cover 7.

Meanwhile, the high-voltage board 50 is disposed to stand in parallel to the main board 30 such that a predetermined space is formed between the high-voltage board 50 and the main board 30, and its component mounting surface 50A faces the component mounting surface 30A of the main board 30. That is, the high-voltage board 50 is disposed on an outer side relative to the main board 30, and is disposed in the vicinity of the outer cover 7. Therefore, it is possible to use the high-voltage board 50 as a shield plate for the main board 30.

Also, the low-voltage board 20 is connected to a lower end of the high-voltage board 50, and is disposed such that its component mounting surface 20A faces in the same direction as the mounting surface 50A of the high-voltage board 50. That is, the low-voltage board 20 is disposed in parallel to the main board 30 such that a predetermined space is formed between the low-voltage board 20 and the main board 30 and the component mounting surface 20A faces the mounting surface 30A of the main board 30. Therefore, it is possible to efficiently dispose the low-voltage board 20, the main board 30, and the high-voltage board 50, and it becomes easy for air to flow in the space formed among the main board 30, the low-voltage board 20, and the high-voltage board 50. Further, a slight gap may be formed between the lower end of the high-voltage board 50 and the upper end of the low-voltage board 20.

The low-voltage board 20, the main board 30, the high-voltage board 50 are formed in rectangular shapes different in size, as shown in FIG. 2. The high-voltage board 50 is formed to be longest in the horizontal direction among the boards, and includes a circuit on the primary side (hereinafter, referred to as a primary circuit) 50B formed on its rear side (the rear side in FIG. 2), and a circuit on the secondary side (hereinafter, referred to as a secondary circuit) 50C formed on its front side (the front side in FIG. 2). More specifically, as shown in FIG. 4, in the high-voltage board 50, taking the transformer 40 as a boundary, the primary circuit 50B is disposed almost on the rear side relative to the primary coil 40A, and the secondary circuit 50C is disposed almost on the front side relative to the secondary coil 40B.

The low-voltage board 20 is formed to have the substantially same height as that of the high-voltage board 50, and a horizontal length shorter than that of the high-voltage board 50. Further, as shown in FIG. 2, the low-voltage board 20 is disposed such that its front end position corresponds to the front end position of the high-voltage board 50, and its rear end position is located at a position close to the rear end of the primary circuit 50B of the high-voltage board 50.

The main board 30 is formed to be shortest in the horizontal direction, have a horizontal length which is about half of that of the high-voltage board 50, and be slightly longer than the high-voltage board 50 in a vertical direction. Further, as shown in FIG. 2, the main board 30 is disposed such that its front end position overlaps the substantial center of the primary circuit 50B of the high-voltage board 50, and its rear end position extends to the vicinity of a rear portion of the casing 3. Also, the main board 30 is positioned such that its upper end is slightly higher than the upper end of the high-voltage board 50, and its lower end extends to a position slightly lower than the lower end of the high-voltage board 50.

That is, the main board 30, the low-voltage board 20, and the high-voltage board 50 are arranged such that the front end position of the main board 30 becomes a straight line VL shown by a dotted line in FIG. 4, that is, the main board 30 overlaps a region 50D of the primary circuit 50B on the rear side relative to the straight line VL in the high-voltage board 50, and slightly overlaps a region 20B positioned at the upper rear end of the low-voltage board 20 shown in FIG. 2.

Here, the position of the straight line VL, i.e. the front end position of the main board 30 is disposed so as not to overlap the transistor 41 serving as a switching element which is turned on or off for controlling a current to be supplied to the transformer 40 as well as the transformer 40 serving as the transforming element for generating the back electromotive force to transform the voltage of the primary circuit 50B, thereby generating a high voltage at the secondary circuit 50C.

That is, the main board 30 is disposed to overlap the region 50D of the primary circuit 50B of the high-voltage board 50 which is less likely to generate electric radiation noises, and not to overlap the secondary circuit 50C of the high-voltage board 50, the transformer 40, and the transistor 41 which are more likely to generate electric radiation noises. Therefore, it becomes rare for the main board 30 to receive electric radiation noises radiated from the secondary circuit 50C and electric radiation noises radiated from the transformer 40 and the transistor 41. Also, since the main board 30 does not substantially overlap the low-voltage board 20 in which a relatively high current flows, it also becomes rare for the main board 30 to receive electric radiation noises, heat, or the like radiated from the low-voltage board 20.

<Configuration of Shield Plate>

Also, in the space between the low-voltage board 20 and the main board 30, and the main board 30, a shield plate 80 is provided. This shield plate 80 is formed in a rectangular thin plate shape slightly smaller than the low-voltage board 20, and is provided to stand in parallel to the low-voltage board 20 and face the low-voltage board 20.

Here, at the low-voltage board 20, in order to dissipate heat radiated from a heat generating component such as a mounted transistor, a heat sink 22 is provided to be in contact with the heat generating component, and the shield plate 80 is provided to be in contact with the heat sink 22. That is, the shield plate 80 is in indirect contact with the heat generating component of the low-voltage board 20 through the heat sink 22.

Therefore, the above-described shield plate 80 has not only a function of shielding the electric radiation noise from the low-voltage board 20 but also a function as a heat sink for dissipating heat from the heat generating component of the low-voltage board 20. As the material of the shield plate 80, highly thermal conductive metals such as aluminum, copper, and iron may be preferable.

<Effects of Illustrative Embodiment>

The laser printer 1 configured as the image forming apparatus according to the present invention as described above has the following effects.

(1) In the side region 9 formed by the side wall 5A of the main body frame 5 and the outer cover 7, the main board 30 and the high-voltage board 50 are provided to stand in parallel along the side wall 5A, and the high-voltage board 50 is disposed on the outer side relative to the main board 30. Therefore, it is possible to use the high-voltage board 50 as the shield plate of the main board 30, and suppress an external device from being influenced by the electric radiation noise generated from the main board 30, without separately providing a shield plate dedicated for the main board 30. Also, it is possible to reduce electric radiation noise or the like which the main board 30 receives from the outside.

(2) The main board 30 overlaps only the region 50D of the primary circuit 50B of the high-voltage board 50, and does not overlap the secondary circuit 50C, the transformer 40 (the transforming means), and the transistor 41 (the switching element) which are likely to generate electric radiation noises, such that it is difficult for the main board 30 to receive the electric radiation noise radiated from those devices. Therefore, a possibility that the main board 30 for performing important control on the image forming process will malfunction may be reduced.

(3) The mounting surface 30A of the main board 30 and the mounting surface 50A of the high-voltage board 50 are disposed to face each other with a predetermined space, and the low-voltage board 20 is connected to the lower end of the high-voltage board 50 such that its mounting surface 20A faces in the same direction as the mounting surface 50A. Therefore, it is possible to efficiently cool the components on each of the mounting surfaces 20A, 30A, and 50A by air flowing in the space, and accordingly, to reduce the distance between the main board 30, and the high-voltage board 50 and the low-voltage board 20. That is, it is possible to form the side region 9 small, and to reduce the size of the laser printer 1.

(4) The main board 30 is disposed to not to substantially overlap the low-voltage board 20 in which a relatively high current flows. That is, the main board 30 is disposed to overlap only a small region, that is, the region 20B of the low-voltage board 20. Therefore, it becomes difficult for the main board 30 to receive electric radiation noises, heat, or the like radiated from the low-voltage board 20. As a result, it is unnecessary to implement a countermeasure on the main board 30 against electric radiation noises from the low-voltage board 20, and thus it is also possible to form the main board 30 small.

(5) In the space between the main board 30, and the low-voltage board 20 and the high-voltage board 50, the shield plate 80 is provided to face the low-voltage board 20 and be in contact with the heat sink 22 provided on the low-voltage board 20. Therefore, it is possible to use the shield plate 80 as a heat sink for dissipating heat from the heat generating component of the low-voltage board 20, to enhance the dissipating effect of the low-voltage board 20, and to reduce the size of the heat sink originally provided on the low-voltage board 20.

<Other Illustrative Embodiment>

While the present invention has been shown and described with reference to certain illustrative embodiments thereof, it will be understood by those skilled in the art that various changes in form and details may be made therein without departing from the spirit and scope of the invention as defined by the appended claims.

For example, although the low-voltage board 20 is connected to the lower end of the high-voltage board 50 in the above-mentioned illustrative embodiment, the low-voltage board 20 may be provided integrally with the high-voltage board 50. In other words, it is possible to form the high-voltage generator circuit and the low-voltage circuit on the upper side and lower side of one board, respectively. According to this configuration, in addition to air flowing in the space between the main board 30 and the integral board, formation of the large board makes it easier to dissipate heat based on conduction or radiation.

Further, although the above-described shield plate 80 is in contact with the heat sink 22 of the low-voltage board 20, it is possible to extend the shield plate 80 upward to be in contact with a heat sink 32 of the main board 30 or a heat sink 56 of the high-voltage board 50 shown in FIG. 1, and it is possible to configure the shield plate 80 to be in contact with all of the heat sinks 22, 32, and 56. According to this configuration, it is possible to further enhance the dissipating effect of the shield plate 80.

Alternatively, the shield plate 80 may be provided to be in direct contact with the heat generating component of the low-voltage board 20. According to this configuration, it also becomes possible to omit the heat sink 22 provided on the low-voltage board 20. This is similarly applied to the main board 30 and the high-voltage board 50.

What is claimed is:

1. An image forming apparatus configured to electro-photographically form an image, the image forming apparatus comprising:

a main body frame which includes a side wall;

an outer cover which covers an outer face of the main body frame;

a high-voltage board which includes a high-voltage generator circuit configured to generate a high voltage and supply an electric power to a device requiring a high-voltage power source; and a main board which includes a main control circuit configured to perform a control on an image forming process of the image forming apparatus, wherein in a side region which is formed by the side wall of the main body frame and the outer cover, the high-voltage board and the main board are disposed along the side wall to overlap with each other at least partially, and the high-voltage board is disposed on an outer side relative to the main board, wherein the high-voltage generator circuit includes a transforming element configured to transform a voltage of a primary circuit to generate a high voltage at a secondary circuit, and wherein the main board is disposed to overlap the primary circuit so as not to overlap the secondary circuit.

2. The image forming apparatus according to claim 1, wherein the primary circuit includes a switching element configured to control a current to be supplied to the transforming element, and wherein the main board is disposed so as not to overlap the switching element.

3. An image forming apparatus configured to electro-photographically form an image, the image forming apparatus comprising:

a main body frame which includes a side wall;

an outer cover which covers an outer face of the main body frame;

a high-voltage board which includes a high-voltage generator circuit configured to generate a high voltage and supply an electric power to a device requiring a high-voltage power source;

a main board which includes a main control circuit configured to perform a control on an image forming process of the image forming apparatus; and a low-voltage board which includes a low-voltage circuit configured to lower a voltage from an external power source to a predetermined voltage and supply an electric power to at least the main board, wherein in a side region which is formed by the side wall of the main body frame and the outer cover, the high-voltage board and the main board are disposed along the side wall to overlap with each other at least partially, and the high-voltage board is disposed on an outer side relative to the main board, and wherein the low-voltage board is connected to a lower end of the high-voltage board or is provided integrally with the lower end of the high-voltage board, and is disposed not to substantially overlap the main board.

4. The image forming apparatus according to claim 3, wherein the main board and at least one of the high-voltage board and the low-voltage board are disposed such that a component mounting surface of the main board faces a component mounting surface of the at least one of the high-voltage board and the low-voltage board, and a predetermined space is formed therebetween.

5. The image forming apparatus according to claim 3, further comprising:

a shield plate disposed between the main board and at least one of the high-voltage board and the low-voltage board, wherein the shield plate directly or indirectly contracts a heat generating component of at least one of the main board, the high-voltage board and the low-voltage board to operate as a heat sink.

6. The image forming apparatus according to claim 3, wherein the high-voltage generator circuit includes a transforming element configured to transform a voltage of a primary circuit to generate a high voltage at a secondary circuit, and wherein the main board is disposed to overlap the primary circuit so as not to overlap the secondary circuit.

7. The image forming apparatus according to claim 6, wherein the primary circuit includes a switching element configured to control a current to be supplied to the transforming element, and wherein the main board is disposed so as not to overlap the switching element.

* * * * *